US012063967B2

(12) United States Patent
Hon et al.

(10) Patent No.: US 12,063,967 B2
(45) Date of Patent: Aug. 20, 2024

(54) ELECTRONIC VAPORIZING DEVICE WITH THIN FILM HEATING MEMBER

(71) Applicant: FONTEM VENTURES B.V., Amsterdam (NL)

(72) Inventors: Lik Hon, Beijing (CN); Zhuoran Li, Beijing (CN); Fucheng Yu, Beijing (CN)

(73) Assignee: FONTEM VENTURES B.V., Amsterdam (NL)

( * ) Notice: Subject to any disclaimer, the term of this patent is extended or adjusted under 35 U.S.C. 154(b) by 724 days.

(21) Appl. No.: 17/263,128

(22) PCT Filed: Aug. 1, 2018

(86) PCT No.: PCT/CN2018/098053
§ 371 (c)(1),
(2) Date: Jan. 25, 2021

(87) PCT Pub. No.: WO2020/024155
PCT Pub. Date: Feb. 6, 2020

(65) Prior Publication Data

US 2021/0145060 A1 May 20, 2021

(51) Int. Cl.
*A24F 40/46* (2020.01)
*A24F 40/485* (2020.01)
*A24F 40/51* (2020.01)

(52) U.S. Cl.
CPC ..... *A24F 40/46* (2020.01); *A24F 40/485* (2020.01); *A24F 40/51* (2020.01)

(58) Field of Classification Search
CPC ..... A24F 40/46; A24F 40/485; A24F 40/51
USPC ..... 131/329
See application file for complete search history.

(56) References Cited

U.S. PATENT DOCUMENTS

| | | | | |
|---|---|---|---|---|
| 9,320,300 | B2 | 4/2016 | Hon | |
| 9,572,373 | B2 * | 2/2017 | Chen | A61M 15/06 |
| 9,814,269 | B2 | 11/2017 | Li et al. | |
| 10,375,996 | B2 | 8/2019 | Aoun et al. | |
| 10,383,366 | B2 | 8/2019 | Hon | |
| 10,588,350 | B2 | 3/2020 | Yu | |
| 10,602,777 | B2 | 3/2020 | Dickens | |

(Continued)

FOREIGN PATENT DOCUMENTS

| | | |
|---|---|---|
| CN | 10116542 A | 2/2008 |
| CN | 203234038 U | 10/2013 |

(Continued)

OTHER PUBLICATIONS

EPO, Extended European Search Report in European Application No. 18928762.6; Date of Mailing: Mar. 4, 2022; 7 pages.

(Continued)

*Primary Examiner* — Gary F Paumen
(74) *Attorney, Agent, or Firm* — Perkins Coie LLP

(57) ABSTRACT

An electronic vaporizing device has an air flow tube passing through a liquid storage chamber (210). The air flow tube has a plurality of micro-openings (122). A thin film heating element (121) is provided on an inner wall of the air flow tube. A plurality of micro-openings in the thin film heating element (121) are aligned with the plurality of micro-openings in the airflow tube to provide a flow of liquid from the liquid storage chamber (210) to the thin film heating element (121).

17 Claims, 4 Drawing Sheets

(56) References Cited

U.S. PATENT DOCUMENTS

| | | | |
|---|---|---|---|
| 10,881,138 | B2 | 1/2021 | Saleem et al. |
| 2015/0090280 | A1 | 4/2015 | Chen |
| 2015/0181943 | A1 | 7/2015 | Li et al. |
| 2015/0196055 | A1 | 7/2015 | Liu |
| 2017/0106113 | A1 | 4/2017 | Meinhart et al. |
| 2017/0251729 | A1 | 9/2017 | Li et al. |
| 2017/0360088 | A1 | 12/2017 | Pijnenburg |
| 2019/0124992 | A1 | 5/2019 | Nakano et al. |

FOREIGN PATENT DOCUMENTS

| | | | |
|---|---|---|---|
| CN | 203523811 | U | 4/2014 |
| CN | 206101584 | U | 4/2017 |
| CN | 107182139 | A | 9/2017 |
| CN | 207185906 | U | 4/2018 |
| RU | 2311859 | C2 | 12/2007 |
| WO | 2014169422 | A1 | 10/2014 |
| WO | 2015071703 | A1 | 5/2015 |
| WO | 2018002989 | A1 | 1/2018 |

OTHER PUBLICATIONS

International Search Report and Written Opinion for PCT/CN2018/098053, dated Apr. 29, 2019.

Patent Office of the Russian Federation, Official Notification and Search Report dated Sep. 8, 2021 for Application No. 2021104738, 12 pages.

JPO, Office Action for Japanese Application No. 2021-505327; Date of Mailing: Feb. 28, 2023; 11 pages with English translation.

JPO, Office Action for Japanese Application No. 2021-505327; Date of Mailing: Aug. 2, 2022; 9 pages.

IP Office China, First Office Action for Application No. 201880096245.5, Date of Mailing: Dec. 5, 2023, 13 pages with English translation.

EPO, Exam Report for Application No. 18928762.6, Mail Date: Feb. 14, 2024, 4 pages.

* cited by examiner

ELECTRONIC VAPORIZING DEVICE WITH THIN FILM HEATING MEMBER

TECHNICAL FIELD

The field of the invention is smoking articles, and more particularly, electronic smoking articles having a thin film heating member.

BACKGROUND OF THE INVENTION

An electronic smoking article, such as an electronic cigarette (e-cig or e-cigarette), electronic cigar, electronic vaporizing device, personal vaporizer (PV) or electronic nicotine delivery system (ENDS), is a battery-powered vaporizer which creates an aerosol or vapor. In general, these devices have a heating element that atomizes a liquid solution known as e-liquid. There remains a need for novel electronic vaporizing devices with novel atomization systems and/or novel liquid supply mechanisms that offers a more enjoyable experience.

SUMMARY OF THE INVENTION

In a first aspect, an electronic vaporizing device has an airflow passage (e.g., an air flow tube) passing through a liquid storage chamber. A heating element (e.g., a heating film) is provided on an inner wall of the airflow passage. The heating element is in close proximity with one or more micro-openings in the inner wall of the airflow passage, which are in liquid communication with one or more micro-openings on a housing of the liquid storage chamber to provide a flow of liquid from the liquid storage chamber to the heating element. The heating element may also have one or more micro-openings in liquid communication with the one or more micro-openings in the inner wall of the airflow passage. The micro-openings are small enough that liquid surface tension blocks the liquid from leaking out of the liquid storage chamber, while allowing liquid to access the heating element for vaporization.

In another aspect, a novel electronic vaporizing device has a first housing having an inhalation unit and an atomization unit; and a second housing defining a liquid-storage chamber. The atomization unit has a heating element on an inner wall of the first housing. The first housing has multiple micro-openings. Optionally, the heating element also has multiple micro-openings optionally in liquid communication with one or more micro-openings on the first housing. The second housing has one or more micro-openings in liquid communication with the one or more micro-openings on the first housing to allow an e-liquid in the liquid-storage chamber to access the atomization unit for atomization. The electronic vaporizing device optionally further has a battery unit for activating the atomization unit.

DETAILED DESCRIPTION

Figure 1A:
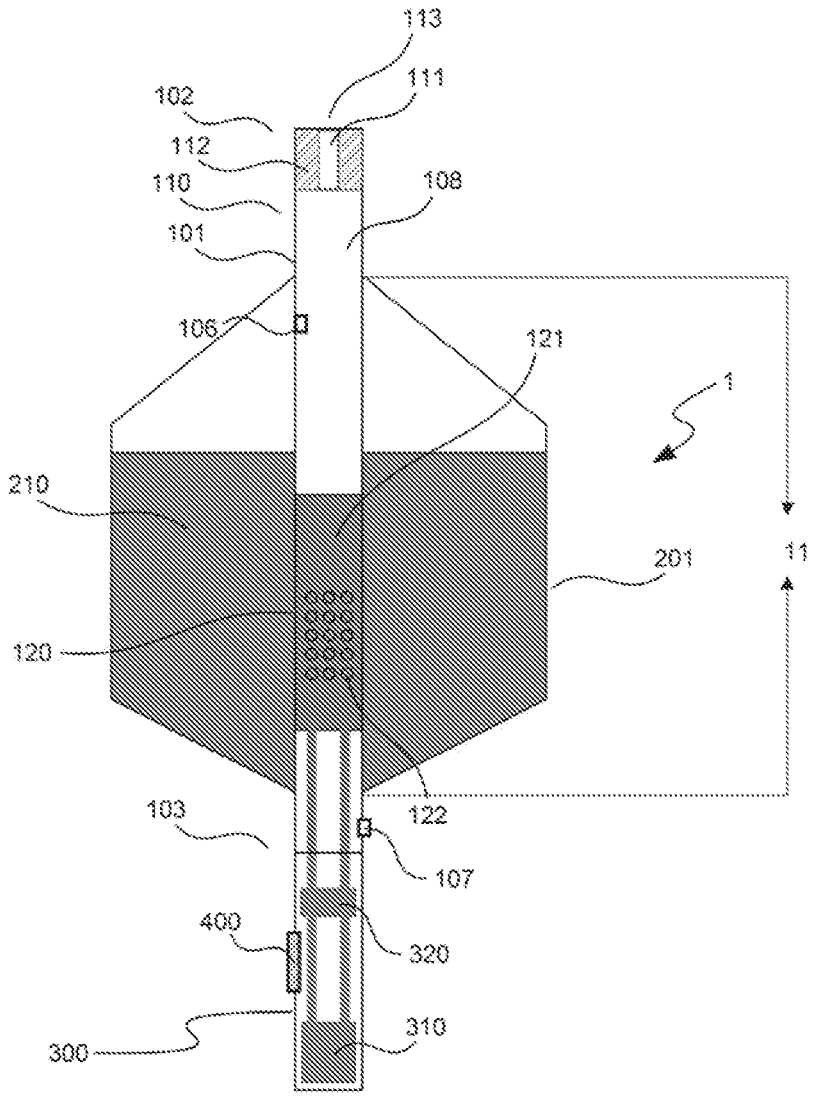
FIG. 1A is a section view of an embodiment of the electronic vaporizing device disclosed herein.

The electronic vaporizing device disclosed herein has a liquid storage chamber surrounding an airflow passage. The airflow passage is surrounded by at least part of a first housing of the electronic vaporizing device. The liquid storage chamber is defined by a second housing. A heating element is provided on an inner wall of the airflow passage. The airflow passage has one or more first micro-openings on the first housing that are in liquid communication with one or more second micro-openings on the second housing of the liquid storage chamber. One or more of the first micro-openings contact or are in close proximity with the heating element. The first and second housings may be separable from each other. Alternatively, the first and second housings are not separable. Optionally, the first and second housings may share a common wall, and one or more of the first and second micro-openings may be the same micro-openings penetrating the common wall. The heating element may have one or more third micro-openings in liquid communication with one or more of the first micro-openings. The first, second and third micro-openings are small enough that liquid surface tension blocks an e-liquid from leaking out of the liquid storage chamber, while allowing the e-liquid to access the heating element for vaporization. Optionally, the first, second and/or third micro-openings are aligned to allow the liquid communication from the liquid storage chamber to contact and/or be in close proximity with the heating element.

The liquid storage chamber and/or the airflow passage may be disposable.

An e-liquid may produce a mist or vapour when heated by an atomizer. It may include one or more chemicals selected from the group consisting of propylene glycol (PG), vegetable glycerin (VG), polyethylene glycol 400 (PEG400), and alcohols, and one or more agents selected from the group consisting of flavors (e.g., tobacco flavors, food flavors such as flavors of candy, nuts, fruit, bakery, dairy, cream, spice and vegetable, beverage flavors, floral flavors, sweet flavors, and sour flavors) and nicotine. The e-liquid may include nicotine at various concentrations or may be nicotine-free. Nicotine may be synthetic or tobacco-derived nicotine products.

The heating element may be activated by a sensor that responds to inhalation and/or by a switch. The heating element heats the e-liquid contacting or in close proximity with the heating element into an aerosol that passes through the airflow passage for inhalation by a user.

FIGS. 1A-1B and 2A-2B illustrate various embodiments of the electronic vaporizing device 1. The electronic vaporizing device 1 has a first housing 101, at least a portion of which forms an airflow passage 108; an inhalation unit 110; an atomization unit 120 on an inner wall 104 of the airflow passage 108; a second housing 201 forming a liquid-storage chamber 210; and the first housing 101 and the second housing 201 have an overlapping portion 11; and a battery unit 300 having a battery 310 for activating the atomization unit 120. The first housing 101 and the second housing 201 may share a common wall at at least part of the overlapping portion 11 (as shown in FIGS. 1A-1B and 2A-2B). Alternatively, the first housing 101 and the second housing 201 may be distinct from each other at the overlapping portion 11, i.e., the first housing 11*a* and the second housing 11*b* shown in FIG. 3.

The first housing 101 and the second housing 201 may be made of the same or different materials. Examples of suitable materials may be nonconductive and include, without limitation, polymer, ceramic and glass materials. In certain embodiments, the first and second housing do not include a porous material.

The first housing 101 has a first end 102 and a second end 103.

The inhalation unit 110 may have a mouthpiece 111 with an outlet 113 at the first end 102, the outlet 113 is in airflow communication with airflow passage 108. Optionally, the inhalation unit has a filter 112 including one more filter materials. Examples of filter materials include, without limitation, filter materials suitable for conventional cigarettes, porous materials, and absorbent materials. Examples of the porous materials include, without limitation, micro-porous ceramic, foamed ceramic, natural fiber, artificial fiber or foam metal material. Examples of fibers include, without limitation, ceramic fiber, quartz fiber, glass fiber, and aramid fiber.

The atomization unit 120 is in airflow communication with the inhalation unit 110 through the airflow passage 108 in the first housing 101. The atomization unit 120 has a heating element 121 and multiple micro-openings 122 in the inner wall 104 of the airflow passage 108.

The heating element 121 includes one or more conductive materials in close proximity with and/or surrounding the micro-openings 122. Examples of conductive materials include, without limitation, metals (e.g., aluminum, barium, chromium, cobalt, copper, gold, ion, iridium, lead, lithium, magnesium, manganese, molybdenum, muonium, niobium, nickel, osmium, palladium, platinum, rhenium, rhodium, ruthenium, silver, steel, strontium, tantalum, thallium, titanium, tungsten, vanadium, zinc, zirconium) and alloys formed by any combinations thereof (e.g., brass); carbon (e.g., graphite, graphene, and/or carbon-based nanomaterials); metal oxides (e.g., $ZrO_2$, $TrO_2$, $Al_3O_2$, $MoO_3$, n-Ba-$TiO_3$, $(Fe,Ti)_2O_3$, $ReO_3$, $RuO_2$, $IrO_2$, indium tin oxides (ITO)); metal salts including, without limitation, borides (e.g., $TiB_2$), carbides (e.g., SiC, $B_4C$), metal halides (e.g., LiF, nickel halides), nitrides (e.g., TiN, AlN), silicides (e.g., $MoSi_2$); and conductive polymers (e.g., polyimides).

Figure 2A:
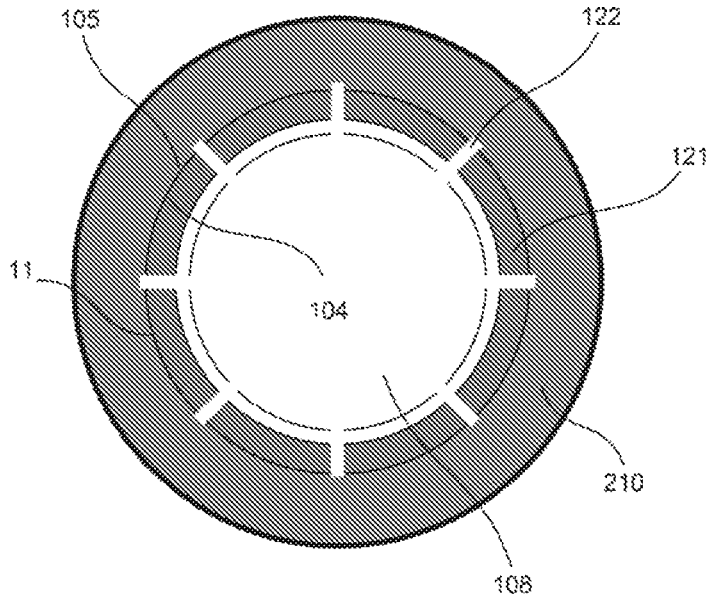
FIG. 2A is a cross-section view of an embodiment of the electronic vaporizing device disclosed herein.
Figure 2B:
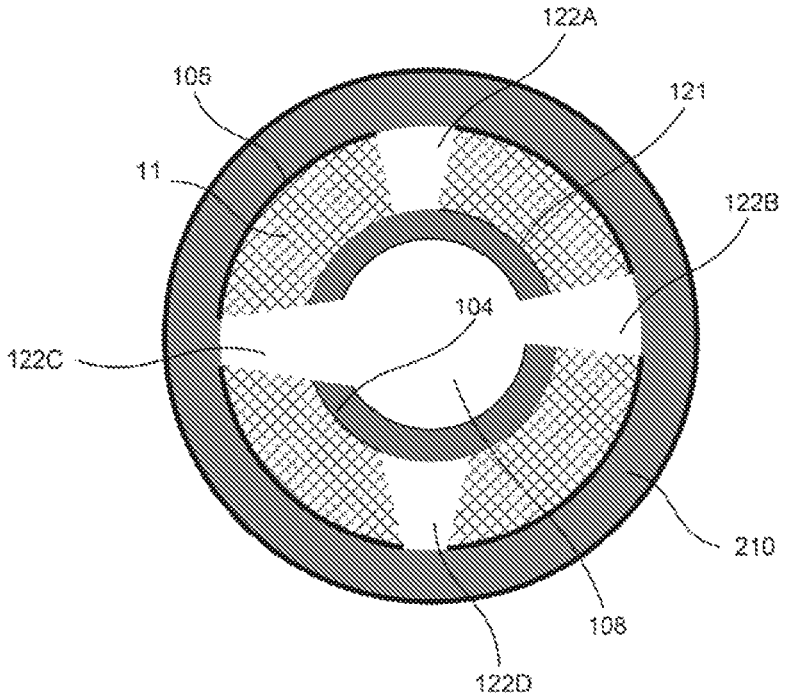
FIG. 2B is a cross-section view of another embodiment of the electronic vaporizing device disclosed herein.
Figure 3:
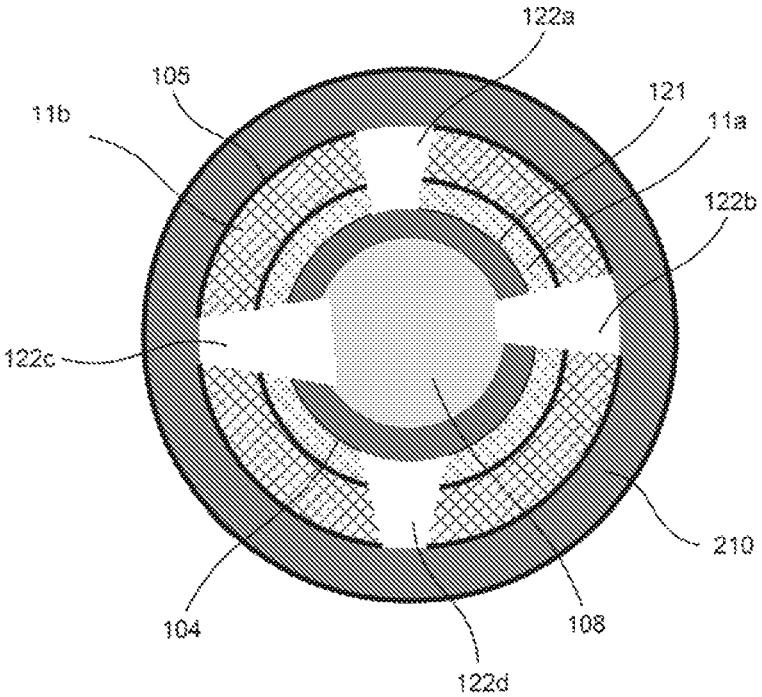
FIG. 3 is a cross-section view of another embodiment of the electronic vaporizing device disclosed herein.

The micro-openings 122 and e-liquid may be configured to prevent leaking of the e-liquid into the airflow passage 108 without inhalation; and to allow the e-liquid to reach the inner wall 104 of the airflow passage 108 during inhalation via capillary action and/or by force of inhalation. When no external force is applied (i.e., without an inhalation), the micro-openings 122 may be sufficiently small that the liquid surface tension around these micro-openings 122 prevents the e-liquid from leaking into the airflow passage 108. The external force needed to cause the e-liquid to pass through micro-openings 122 in combination with capillary action may be optimized by configuring the sizes and/or the shapes of the micro-openings 122 (e.g., circular, rectangular, square, triangular, diamond, or any polygonal shapes), the distances between adjacent micro-openings 122, the distance the e-liquid travels between the liquid storage chamber 210 and the inner wall 104 of the airflow passage 108, and characteristics of the e-liquid (e.g., viscosity, and volatility). A micro-opening 122 is a micro-scale through hole that may have the same or different sizes from the liquid storage side of the overlapping portion 11 (the outer wall 105) to its airflow passage side (the inner wall 104) (FIGS. 2A and 2B). For example, the micro-openings 122 may have a uniform size through the overlapping portion 11, as shown by a cross section view of the overlapping portion 11 in FIG. 2A. Alternatively, one or more micro-openings 122 may have a smaller size on the outer wall 105 and a larger size on the inner wall 104, respectively, to further prevent leaking (See FIG. 2B: 122C and 122D). Alternatively, one or more micro-openings 122 may have a larger size on the outer wall 105 and a smaller size on the inner wall 104, respectively, to further improve liquid supply (See FIG. 2B: 122A and 122B). One or more of the micro-openings 122 may penetrate through the heating element 121 (see FIG. 2B: 122B and 122C).

One or more of the micro-openings 122 may not penetrate through the heating element 121 (See FIG. 2B: 122A and 122C), if the heating element 121 includes one or more porous materials to allow airflow communication of the micro-openings 122 through the heating element 121 with the airflow passage 108. Suitable porous materials may include one or more porous materials that are electrically conductive and/or electrically non-conductive. Examples of electrically conductive porous materials include, without limitation, foams, fibers and micro-porous materials of carbon (e.g., carbon fibers), metals (metal foams and/or fibers), conductive polymers (e.g., polymer foams and/or fiber), conductive ceramics (e.g., micro-porous and foamed ceramics), PTC (Positive Temperature Coefficient) ceramics, and mixtures and composites thereof. Examples of electrically nonconductive porous materials include, without limitation, foams, fibers, and micro-porous materials of non-conductive organic (e.g., polymers such as aramid) and inorganic (e.g. glass, quartz) components, and mixtures and composites thereof. If the heating element is porous, such as carbon or metal fiber or mesh, then micro-openings on the heating element may not need to align with the micro-openings on the inner wall 104.

The micro-openings 122 may have the same or different sizes. For example, each micro-opening 122 may have an open area of about 0.785 $\mu m^2$ to about 19.625 $\mu m^2$, or about 0.5 $\mu m^2$ to about 25 $\mu m^2$. The micro-openings 122 may have the same or different sizes on the inner wall 104 and/or the outer wall 105 of the first housing 101.

The force required for the e-liquid to pass through the micro-openings 122 may be further adjusted by the travel distance of the e-liquid from the liquid storage chamber to the innerwall of the airflow passage. The longer the travel distance, the more force is needed to draw the e-liquid through the micro-openings 122.

The micro-openings 122 may have the same or varied distances between adjacent micro-openings. The overlapping portion 11 may have 50 to about 1,000, about 100 to about 800, about 200 to about 500, or about 300 to about 400 micro-openings 122. The micro-openings 122 may be arranged into any desired pattern provided that the shortest distance between any adjacent micro-openings is at least 10 μm, about 10 μm to about 100 μm, about 10 μm to about 75 μm, about 10 μm to about 50 μm, about 10 μm to about 30 μm, or about 10 μm to about 20 μm.

The liquid-storage chamber 210 is defined by the second housing 201. The second housing surrounds at least the overlapping portion 11 of the airflow passage 108. The liquid-storage chamber 210 may be any shape suitable (e.g., tubular, cubic, triangular, hexangular, or polygonal). The overlapping portion 11 includes atomization unit 121 of the first housing 101.

The battery unit 300 at the second end 103 of the first housing 101 activates the atomization unit 120 for aerosol generation. The battery unit 300 contains a battery 310 and optionally a control circuit 320 and/or switch 400 for activating the atomization unit 120. The control circuit 320 may be activated by a sensor 106 when the sensor senses inhalation. The control circuit may also be activated by the switch 400.

Figure 1B:
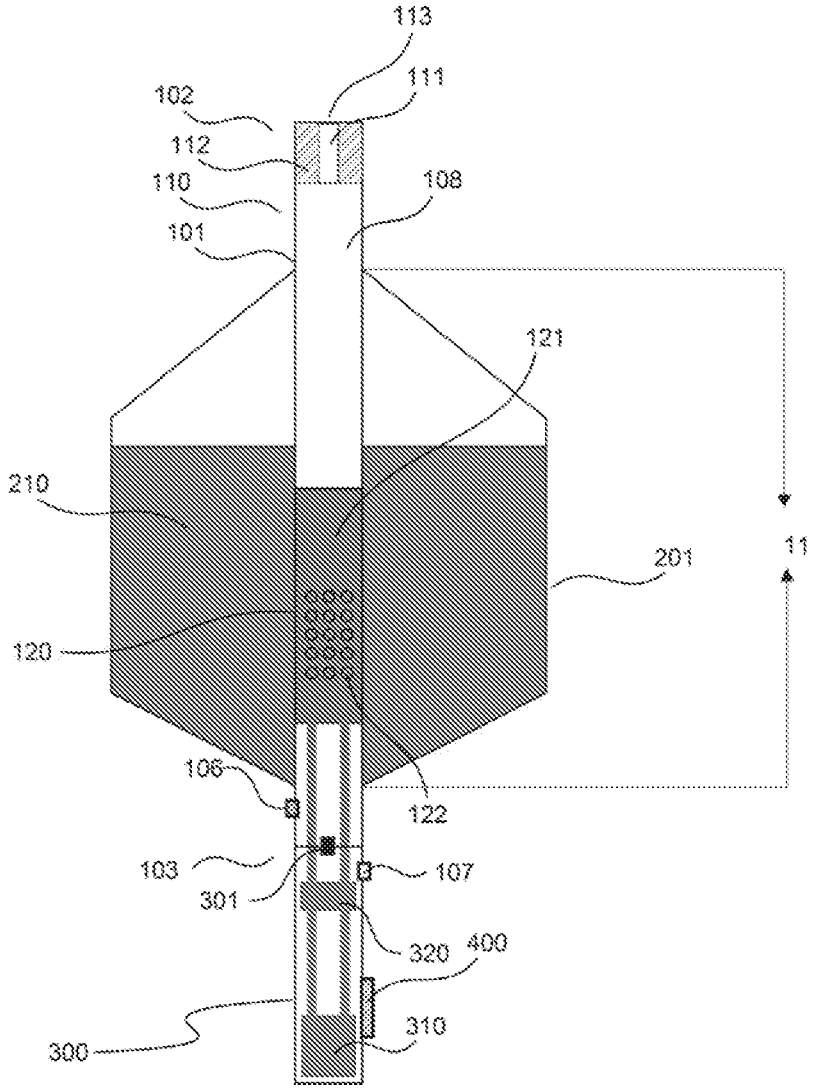
FIG. 1B is a section view of another embodiment of the electronic vaporizing device disclosed herein.

The electronic vaporizing device 1 may further include one or more air inlets 107 allowing air flow into the first housing 101 and out to be inhaled at the outlet 113. The air inlet 107 may be on the first housing 101 (FIG. 1A). The air inlet 107 may optionally be provided in the battery unit 300 (FIG. 1B). The battery unit 300 may be sealed from the airflow passage 108 in the first housing 101. The battery unit 300 may further have a one-way valve 301 allowing air flow only in one direction into the first housing 101 (FIG. 1B).

When a user inhales, air drawn from one or more air inlets 107 into the first housing 101 flows into the airflow passage 108 and passes the atomization unit 120 to mix with a vapour generated by the heating element 121 to provide an aerosol that reaches the inhalation unit 110 for inhalation from the outlet 113. The heating element 121 of the atomization unit 120 may be triggered by either turning on the switch 400 or the sensor 106 sensing the air flow. E-liquid contacting or in close proximity with the heating element 121 is vaporized. Additional e-liquid may travel from the liquid storage chamber to the inner wall of the airflow passage as a result of the inhalation force and capillary actions for further vaporization.

Thus, novel devices have been shown and described. Various modifications and substitutions may of course be made without departing from the spirit and scope of the invention.

The invention claimed is:

1. An electronic vaporizing device, comprising:

an airflow tube having a first section in a liquid storage chamber;

a heating element on an inner surface of the first section of the airflow tube;

a plurality of first micro-openings in the first section of the airflow tube extending radially in a straight line from the liquid storage chamber to the heating element to allow liquid to move from the liquid storage chamber to the heating element; and a battery electrically connected to the heating element.

2. The electronic vaporizing device of claim 1 wherein the heating element comprises a hollow cylindrical porous material.

3. The electronic vaporizing device of claim 1 wherein the heating element has a plurality of second micro-openings and the liquid moves through the plurality of first micro-openings and into the plurality of second micro-openings.

4. The electronic vaporizing device of claim 1 wherein each micro-opening has an area of 0.785 $\mu m^2$ to 19.625 $\mu m^2$.

5. The electronic vaporizing device of claim 1 wherein substantially all of the micro-openings have the same area.

6. The electronic vaporizing device of claim 1 wherein the heating element comprises an electrically conductive material and has a plurality of second micro-openings.

7. The electronic vaporizing device of claim 1 wherein the micro-openings are small enough to allow liquid to move out of the liquid storage chamber only during inhalation.

8. An electronic vaporizing device, comprising:

a first housing and a second housing;

the first housing having a first portion in a liquid storage chamber;

a heating element contacting an inner wall of the first portion of the first housing;

a plurality of first micro-openings in the first portion of the first housing, to allow liquid to move from the liquid storage chamber to the heating element, substantially each of the first micro-openings having the same area;

a plurality of second micro-openings in the heating element, the plurality of second micro-openings in the heating element adapted to receive liquid from the plurality of first micro-openings; and a battery electrically connected to the heating element.

9. The electronic vaporizing device of claim 8 wherein the heating element is a non-porous material.

10. The electronic vaporizing device of claim 8 wherein the first and second micro-openings extend in a straight line.

11. The electronic vaporizing device of claim 8 wherein substantially each of the second micro-openings has the same area.

12. The electronic vaporizing device of claim 8 further including a plurality of third micro-openings in the liquid storage chamber positioned to provide liquid to the heating element.

13. The electronic vaporizing device of claim 8 wherein each micro-opening has an area of 0.785 $\mu m^2$ to 19.625 $\mu m^2$.

14. The electronic vaporizing device of claim 8 wherein the heating element comprises a metal thin film heating element.

15. The electronic vaporizing device of claim 8 wherein the first housing comprises a tube extending entirely through the second housing, and the battery is in the first housing.

16. An electronic vaporizing device, comprising:

an airflow tube having a first section in a liquid storage chamber;

a heating element on an inner surface of the first section of the airflow tube;

a plurality of first micro-openings in the first section of the airflow tube extending radially from the liquid storage chamber to the heating element to allow liquid to move from the liquid storage chamber to the heating element, substantially all of the micro-openings having the same area; and a battery electrically connected to the heating element.

17. The electronic vaporizing device of claim 16 wherein the first micro-openings extend in a straight line.

* * * * *